US008727163B2

(12) United States Patent
Chrisman

(10) Patent No.: US 8,727,163 B2
(45) Date of Patent: May 20, 2014

(54) SPLASH RESISTANT LIDS, CONTAINER ASSEMBLIES INCLUDING SUCH LIDS AND RELATED METHODS

(76) Inventor: Joel Chrisman, Tacoma, WA (US)

( * ) Notice: Subject to any disclaimer, the term of this patent is extended or adjusted under 35 U.S.C. 154(b) by 316 days.

(21) Appl. No.: 12/762,189

(22) Filed: Apr. 16, 2010

(65) Prior Publication Data

US 2010/0264143 A1 Oct. 21, 2010

Related U.S. Application Data

(60) Provisional application No. 61/169,811, filed on Apr. 16, 2009.

(51) Int. Cl.

| | |
|---|---|
| ***A47G 19/22*** | (2006.01) |
| ***B65D 1/40*** | (2006.01) |
| ***B65D 3/28*** | (2006.01) |
| ***B65D 51/18*** | (2006.01) |
| ***B65D 51/16*** | (2006.01) |
| ***B65D 43/03*** | (2006.01) |
| ***B65D 55/00*** | (2006.01) |
| ***B65D 53/00*** | (2006.01) |

(52) U.S. Cl.
USPC ..... 220/254.3; 220/367.1; 220/369; 220/380; 220/714; 220/731; 215/260; 215/270

(58) Field of Classification Search
USPC ..... 220/254.3, 380, 714, 731, 367.1, 369; 215/260, 270
See application file for complete search history.

(56) References Cited

U.S. PATENT DOCUMENTS

| | | | | |
|---|---|---|---|---|
| 3,165,242 | A * | 1/1965 | Jackson | 222/495 |
| 3,416,712 | A * | 12/1968 | Shastal | 222/541.5 |
| 3,850,337 | A | 11/1974 | Parks | |
| 4,245,752 | A | 1/1981 | Prueher | |
| 4,441,623 | A | 4/1984 | Antoniak | |
| D274,983 | S | 8/1984 | Dart | |
| 4,767,019 | A * | 8/1988 | Horner | 220/713 |
| 4,782,975 | A | 11/1988 | Coy | |
| 4,828,141 | A * | 5/1989 | Coy | 220/380 |
| 5,065,880 | A * | 11/1991 | Horner | 220/711 |
| 5,890,621 | A | 4/1999 | Bachman et al. | |
| D437,223 | S | 2/2001 | Coy et al. | |
| 6,220,476 | B1 * | 4/2001 | Waller | 220/719 |
| 6,431,390 | B1 | 8/2002 | Waller | |
| 6,523,712 | B1 | 2/2003 | McGushion | |
| 6,659,302 | B2 | 12/2003 | Lin | |
| 6,991,128 | B1 | 1/2006 | Russo et al. | |
| 2006/0071008 | A1 | 4/2006 | Sadlier | |
| 2006/0261064 | A1 * | 11/2006 | Holley, Jr. | 220/203.06 |

* cited by examiner

*Primary Examiner* — Fenn Mathew
*Assistant Examiner* — Andrew T Kirsch
(74) *Attorney, Agent, or Firm* — TraskBritt

(57) ABSTRACT

In some embodiments, a lid may include a valve chamber comprising a hollow chamber, a valve flap and a hinge. The hollow chamber may be defined by one or more sidewalls and have a first opening at a first longitudinal end and a second opening at an opposing, second longitudinal end. The valve flap may be positioned at least proximate to the second longitudinal end and have a shape and size substantially the same as a shape and size of the second opening. The hinge may couple the valve flap to a sidewall of the one or more sidewalls and may be sized and configured to enable the rotation of the valve flap from an open position to a substantially closed position. Container assemblies and methods of forming lids are also disclosed.

17 Claims, 7 Drawing Sheets

SPLASH RESISTANT LIDS, CONTAINER ASSEMBLIES INCLUDING SUCH LIDS AND RELATED METHODS

CROSS-REFERENCE TO RELATED APPLICATION

This application claims the benefit of U.S. Provisional Application No. 61/169,811, filed Apr. 16, 2009, the disclosure of which is incorporated herein, in its entirety, by this reference.

TECHNICAL FIELD

Embodiments of the present disclosure relate to lids for beverage containers and beverage container assemblies including such lids.

BACKGROUND

Fast food restaurants, coffee shops, convenience stores, and the like, often distribute beverages in disposable drinking cups. These cups are often provided with drink-through lids having reversible openings, which permit the consumption of liquids contained therein, while at the same time preventing unwanted spillage. Drink-through lids with reversible openings are especially desirable when distributing hot beverages, such as coffee, tea, hot chocolate, and the like.

Various drink-through lid designs incorporating reversible openings conventionally comprise a lid having a drinking opening and a hinged closure member integrally formed therewith. According to at least one example, the hinged closure member has a radial dimension greater than that of the drinking opening to permit an outward marginal edge portion of the hinged closure member to be trapped between the rim of the drinking cup and an overlying part of the lid. The hinged closure member further includes a raised tab that is received in a complementary recess formed in the lid, when the hinged closure member is rotated outward one-hundred-eighty degrees (180°) about its integral hinge to expose the drinking opening. However, a user must manually move the hinged closure member each time the user wishes to open or close the opening.

Other cup lid designs incorporate reversible openings providing a downwardly depressible tab portion. According to at least one example of such a lid design, the tab portion includes a hollow lip-engaging corrugated buttress to insulatively engage a user's upper lip pressed thereagainst. The buttress also acts to bias the tab portion back into its normally closed position, within a horizontal plane of the lid, when lip pressure is removed therefrom.

BRIEF SUMMARY

In some embodiments, a lid may include a valve chamber comprising a hollow chamber, a valve flap and a hinge. The hollow chamber may be defined by one or more sidewalls and have a first opening at a first longitudinal end and a second opening at an opposing, second longitudinal end. The valve flap may be positioned at least proximate to the second longitudinal end and have a shape and size substantially the same as a shape and size of the second opening. The hinge may couple the valve flap to a sidewall of the one or more sidewalls and may be sized and configured to enable the rotation of the valve flap from an open position to a substantially closed position. Additionally, the hinge may bias the valve flap to the substantially closed position, wherein the valve flap inhibits the flow of liquid through the second opening in the substantially closed position.

In additional embodiments, a container assembly may include a container configured to hold a liquid therein and a lid. The lid may include a valve chamber comprising a hollow chamber, a valve flap and a hinge. The hollow chamber may be defined by one or more sidewalls and have a first opening at a first longitudinal end and a second opening at an opposing, second longitudinal end. The valve flap may be positioned at least proximate to the second longitudinal end and have a shape and size substantially the same as a shape and size of the second opening. The hinge may couple the valve flap to a sidewall of the one or more sidewalls and may be sized and configured to enable the rotation of the valve flap from an open position to a substantially closed position. Additionally, the hinge may bias the valve flap to the substantially closed position, wherein the valve flap inhibits the flow of liquid through the second opening in the substantially closed position.

In further embodiments, a method of forming a lid may include forming a channel to engage and seal around a rim of a container. The method may further include forming a valve chamber, the valve chamber comprising a hollow chamber, a valve flap and a hinge. The hollow chamber may be defined by one or more sidewalls and have a first opening at a first longitudinal end and a second opening at an opposing, second longitudinal end. The valve flap may be positioned at least proximate to the second longitudinal end and have a shape and size substantially the same as a shape and size of the second opening. The hinge may couple the valve flap to a sidewall of the one or more sidewalls and may be sized and configured to enable the rotation of the valve flap from an open position to a substantially closed position. Additionally, the hinge may bias the valve flap to the substantially closed position, wherein the valve flap inhibits the flow of liquid through the second opening in the substantially closed position.

DETAILED DESCRIPTION

The illustrations presented herein are not actual views of any particular lids or beverage container and lid assemblies, but are merely idealized representations that are employed to describe embodiments of the present invention. Additionally, elements common between figures may retain the same numerical designation.

Figure 1:
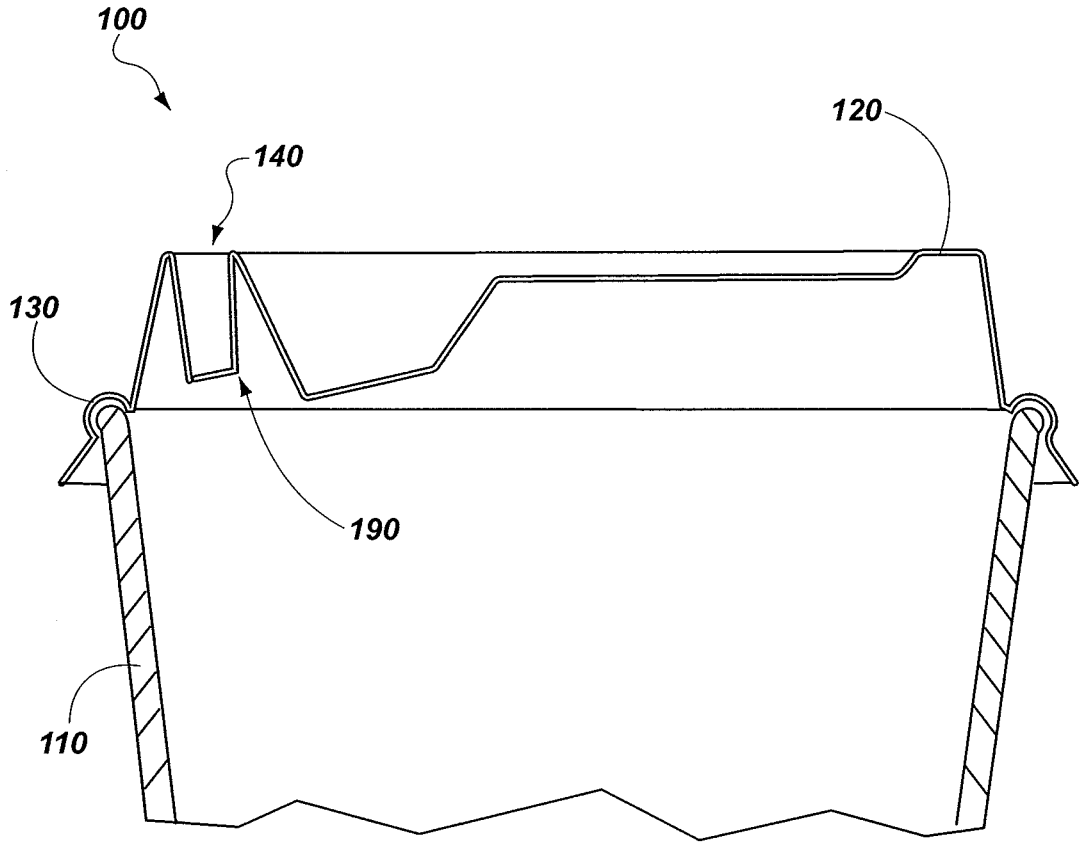
FIG. 1 is a partial cross-sectional view of a beverage container assembly including a container and a lid, according to an embodiment of the invention.
Figure 9:
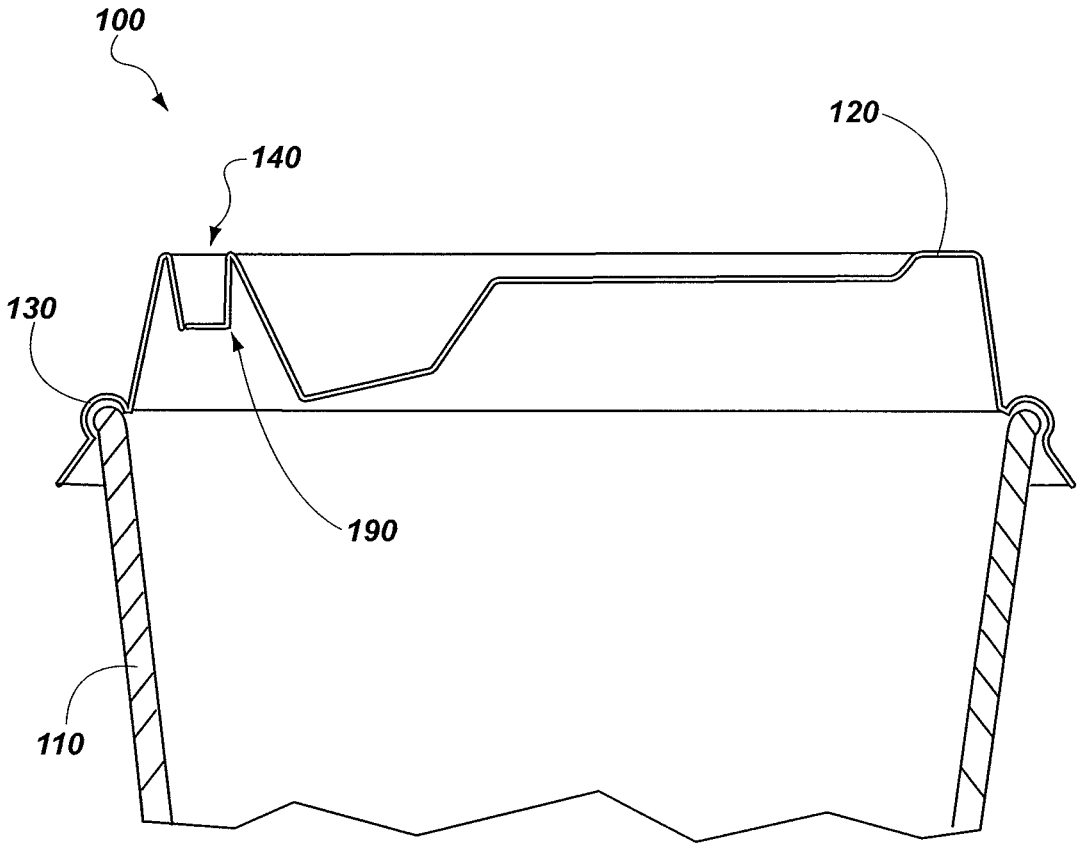
FIG. 9 is a partial cross-sectional view of a beverage container assembly including a container and a lid, according to another embodiment of the invention.

As shown in partial cross-sectional views in FIGS. 1 and 9, a beverage container assembly 100 may include a container 110, such as a cup, having an opening configured to receive a lid 120. Containers 110 are well known to those of ordinary skill in the art and various conventional disposable or reusable containers may be employed. By way of example and not limitation, the container 110 may comprise a conventional disposable coffee cup, insulated or not insulated, a conventional disposable soft-drink cup, such as those used in most fast-food restaurants, or another beverage container.

The lid 120 may be configured to receive a portion of the container 110 and to at least substantially enclose the opening of the container 110. For example, the lid 120 may include a channel 130 configured to engage a rim of the container 110 to form a seal around the opening of the container 110, as is known to those of ordinary skill in the art. The lid may also include a spout with a valve, which may also be characterized as a valve chamber 140.

Figure 2:
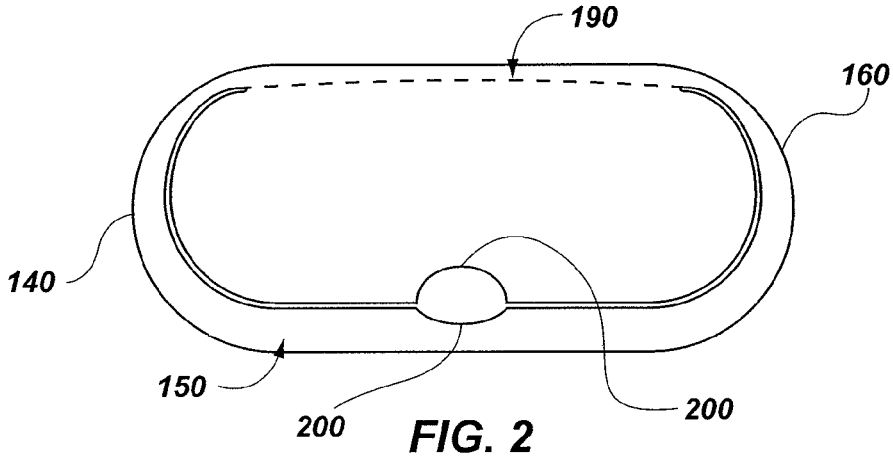
FIG. 2 is a top detail view of a valve chamber of the lid shown in FIG. 1.
Figure 3:
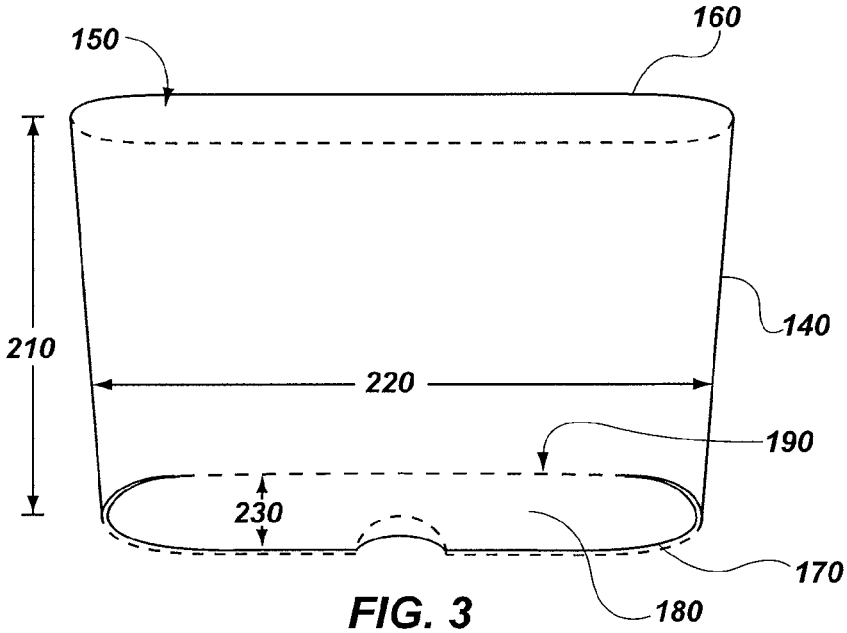
FIG. 3 is a front detail view of the valve chamber of FIG. 2.
Figure 4:
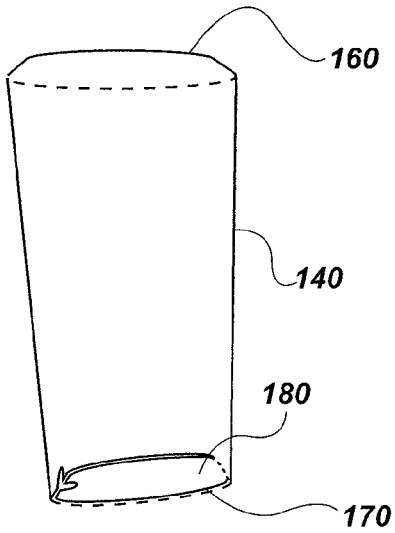
FIG. 4 is a side detail view of the valve chamber of FIG. 2.
Figure 10:
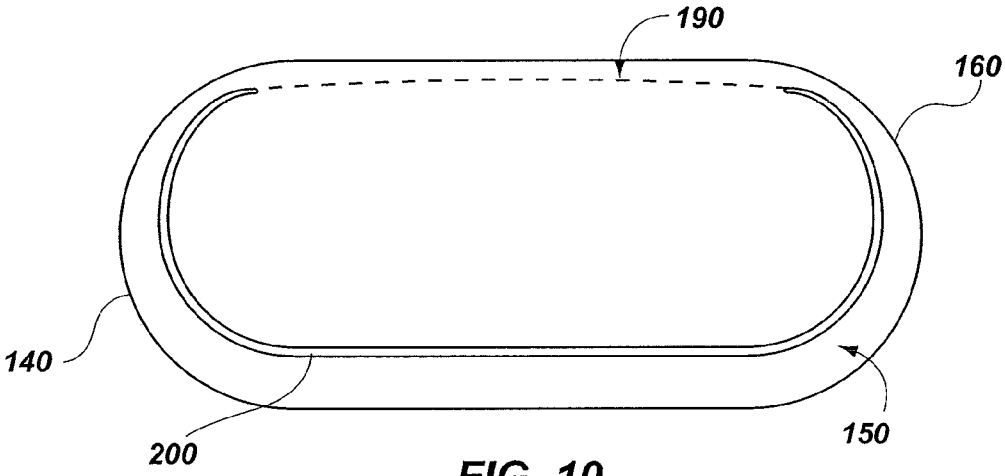
FIG. 10 is a top detail view of a valve chamber of the lid shown in FIG. 9.
Figure 11:
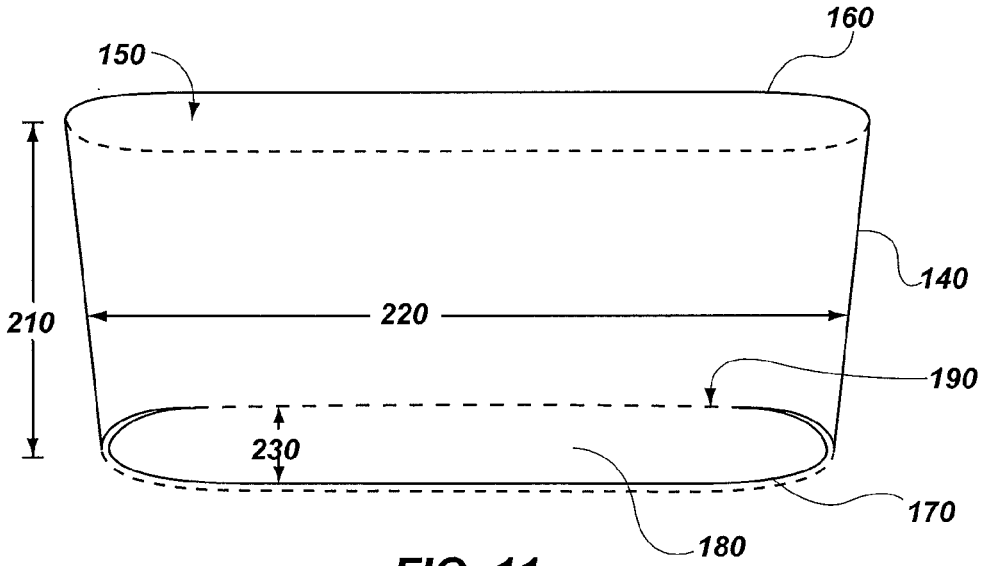
FIG. 11 is a front detail view of the valve chamber of FIG. 10.
Figure 12:
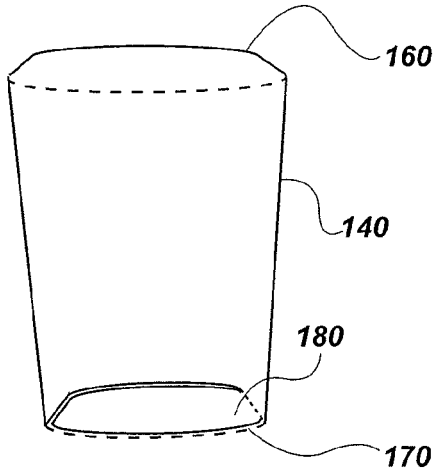
FIG. 12 is a side detail view of the valve chamber of FIG. 10.

As illustrated in FIGS. 2-4 and 10-12, the valve chamber 140 may comprise a hollow chamber having an opening 150 at first longitudinal end 160 thereof (i.e., a top end) and a valve flap 180 at an opposing, second longitudinal end 170 (i.e., a bottom end). The valve chamber 140 may be defined by one or more sidewalls that extend downward from the opening 150 (i.e., from an upper surface of the lid 120). The valve chamber 140 may be configured such that the first longitudinal end 160 may be relatively larger than the second longitudinal end 170. Additionally, the sidewalls of the valve chamber 140 may be sloped at an angle of between about 1° and about 10° relative to vertical (i.e., vertical with respect to an orientation of the lid coupled to a cup resting on a level surface) (e.g., having and angle between about 2° and about 20° relative to an opposing sidewall). In other words, the sidewalls may define a hollow chamber that is tapered from the first longitudinal end 160 to the second longitudinal end 170. By way of example and not limitation, the sidewalls of the valve chamber 140 may be sloped at an angle of about 5° from vertical (e.g., about 10° relative to an opposing sidewall). The valve chamber 140 may comprise any suitable shape conducive to the flow of a fluid therethrough. By way of example and not limitation, the valve chamber 140 may comprise a cross-section that is substantially circular, square, rectangular, oval, etc. Additionally, the valve chamber 140 may comprise a height 210, a width 220 and a depth 230 which may be selected according to the specific application. As a non-limiting example, the valve chamber 140 may comprise a height 210 of about ⅜ of an inch (about 9.5 mm), a width 220 of about ⅜ of an inch (about 9.5 mm), and a depth of about 3/16 of an inch (about 4.8 mm), such as shown in FIGS. 2-4. As another non-limiting example, the valve chamber 140 may comprise a height 210 of about 3/16 of an inch (about 4.8 mm), a width 220 of about ⅜ of an inch (about 9.5 mm), and a depth of about ¼ of an inch (about 6.4 mm), such as shown in FIGS. 10-12.

The valve flap 180 may be positioned at, or at least proximate to, the second longitudinal end 170 of the valve chamber 140 and comprise, at least substantially, the same size and shape as an opening at the second longitudinal end 170 of the valve chamber 140. The valve flap 180 may be coupled to a portion of a sidewall of the valve chamber 140 along at least a portion of one side of the valve flap 180. The remaining sides of the valve flap 180 may be free from the sidewalls of the valve chamber 140. In view of this, the side of the valve flap 180 coupled to the sidewall of the valve chamber 140 may form a hinge 190 (which has a general location indicated by a dashed line) configured to enable the valve flap 180 to rotate between a substantially closed position (as shown in FIGS. 1-4, 7-12 and 15-17) and an open position (as shown in FIGS. 5, 6, 13 and 14).

Although the hinge 190 may be a single portion of the side of the valve flap 180 coupled to the sidewall of the valve chamber 140, as shown, in additional embodiments, the hinge 190 may be comprised of a plurality of portions of the side of the valve flap 180 coupled to the sidewall of the valve chamber 140. The hinge 190 is configured to enable the valve flap 180 to move about the hinge 190. In at least some embodiments, the valve flap 180 may be integrally formed with the lid 120. Additionally, the structure and geometry of the hinge 190 may be configured to bias the valve flap 180 to the substantially closed position.

In some embodiments, as shown in FIGS. 2-8, the valve chamber 140 may include a discrete drain 200 positioned at least proximate to the second longitudinal end 170. The drain 200 may comprise one or more apertures and/or notches disposed in a portion of the valve flap 180, a sidewall of the valve chamber 140 or both. As shown in FIGS. 2-4, the drain 200 may comprise an aperture defined by a notch formed in the valve flap 180 and a corresponding notch formed in a sidewall of the valve chamber 140, the notches being aligned to form the aperture. In some embodiments, the valve chamber 140 may comprise only a single drain 200, while in other embodiments the valve chamber 140 may comprise a plurality of drains 200.

In additional embodiments, as shown in FIGS. 9-17, the valve flap 180 may not form a complete fluid seal with the opening at the second longitudinal end 170 of the valve chamber 140 when the valve flap 180 is in the substantially closed position. In view of this, the drain 200 may be defined by a slit-like opening between the valve flap 180 and the opening in the second longitudinal end 170 of the valve chamber 140 when the valve flap 180 is biased to the substantially closed position, as shown in FIGS. 10-12.

In some embodiments, such as shown in FIGS. 1-4, 7 and 8, the valve flap 180 may be angled with respect to the horizontal (i.e., horizontal to an intended position when the lid is coupled to a cup and the cup is set on a level surface) when in the substantially closed position, with the drain 200 positioned in a portion of the valve flap 180, or near the valve flap 180, at a lowest side, to direct the fluid toward the drain 200.

By way of example and not limitation, the valve flap 180 may be sloped from the hinge 190 downward at an angle between about 1° and 10° relative to horizontal, with the drain 200 positioned proximate the side of the valve flap 180 opposite the hinge 190, when the valve flap 180 is biased to the substantially closed position. In at least some embodiments, the valve flap 180 may be sloped downward from the hinge 190 at an angle between about 5° and 7° relative to horizontal, when the valve flap 180 is biased to the substantially closed position. In additional embodiments, such as shown in FIGS. 9-12 and 15-17, the valve flap 18 may not be sloped relative to horizontal when biased to the substantially closed position. In view of the foregoing, the drain 200 may allow liquid inside the valve chamber 140 to flow back into the container 110 through the drain 200.

Figure 17:
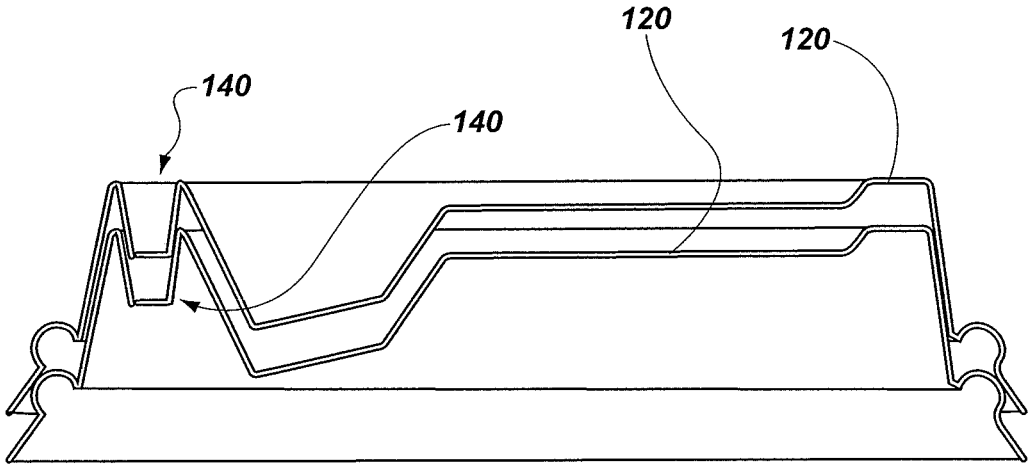
FIG. 17 is a cross-sectional view of lids, such as shown in FIG. 9, in a stacked and nested configuration.

Additionally, the lid 120 may be shaped and configured to be stacked in a nested configuration. For example, multiple lids 120 may be stacked with the valve chambers 140 thereof aligned in a nesting configuration, such that a valve chamber of a first lid 120 may be positioned partially within a valve chamber of a second lid 120 when nested, as shown in FIG. 17. In view of this, a plurality of lids 120 including valve chambers 140 may be stacked and nested for storage, shipping and for dispensing from conventional disposable lid dispensers.

Figure 5:
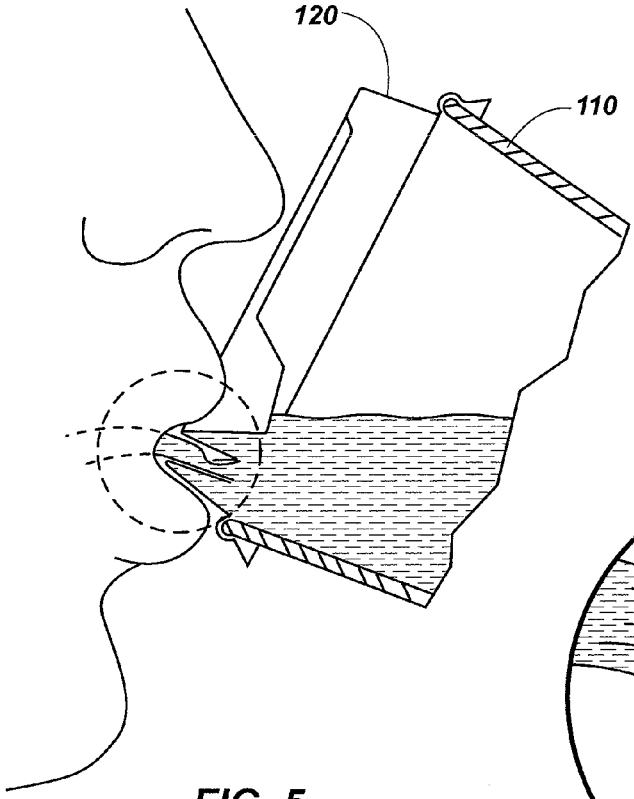
FIG. 5 illustrates the beverage container assembly of FIG. 1 in use by a user drinking a fluid through the lid.
Figure 6:
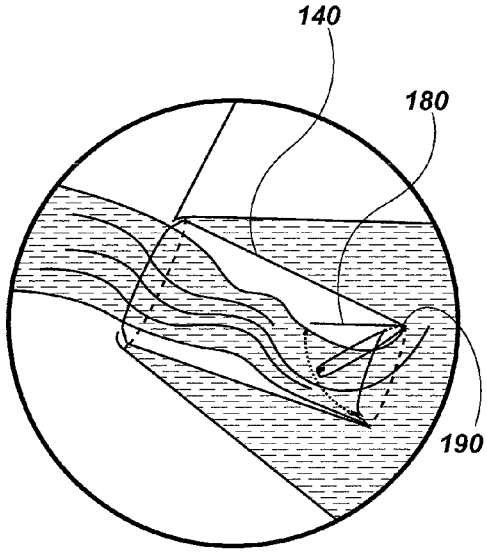
FIG. 6 is a detail view of a valve chamber of the lid of FIG. 5 showing a valve in an open position and fluid flowing therethrough.
Figure 13:
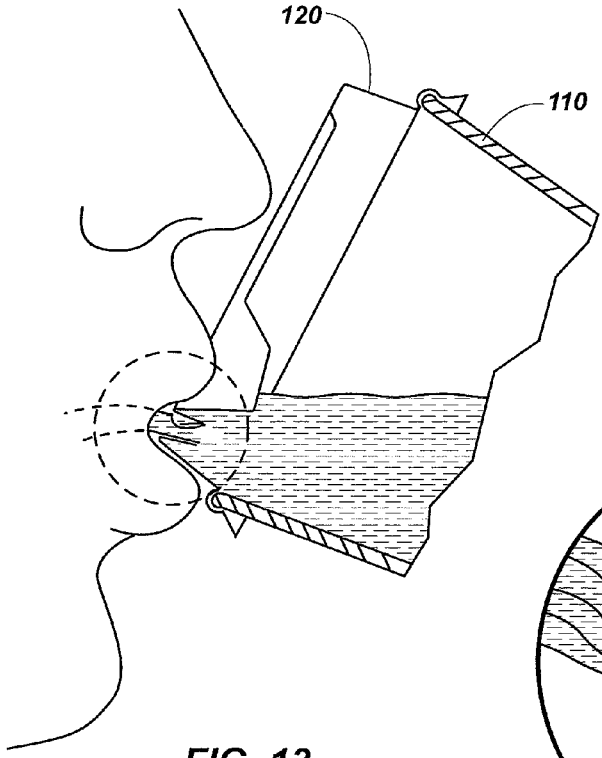
FIG. 13 illustrates the beverage container assembly of FIG. 9 in use by a user drinking a fluid through the lid.
Figure 14:
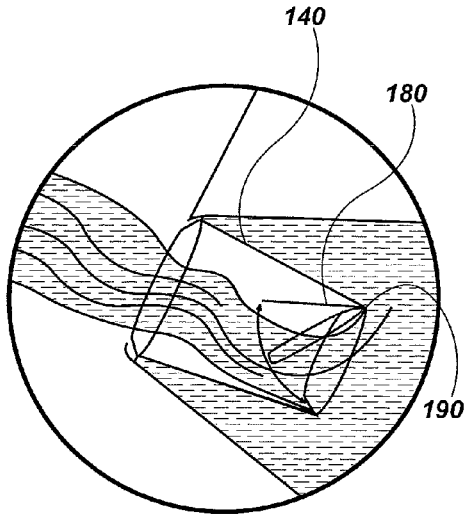
FIG. 14 is a detail view of the valve chamber of the lid of FIG. 13 showing a valve in an open position and fluid flowing therethrough.

In operation, the lid 120 and valve chamber 140 may enable the flow of a liquid from the container 110 to a user's mouth, while inhibiting the flow of the liquid through the valve chamber 140 when the user is not drinking from the container 110. FIGS. 5 and 13 illustrate a container 110 with a lid 120 in operation as a user drinks a liquid from the container 110 and FIGS. 6 and 14 illustrate detail views of embodiments of the valve chamber 140, when a user drinks from the container 110.

For example, a user may place their mouth over the valve chamber 140 and apply suction to the opening 150 at the first longitudinal end 160 of the valve chamber 140. In view of this, the user may create a pressure difference between the inside of the user's mouth and the interior of the container 110. The pressure difference caused by the suction may result in the valve flap 180 moving upward into the valve chamber 140, rotating about the hinge 190, to the open position. With the valve flap 180 rotated upward, in the open position, a fluid path through the valve chamber 140 is opened and liquid contained within the container 110 may flow substantially uninhibited from the container 110 and into the user's mouth through the valve chamber 140.

Figure 7:
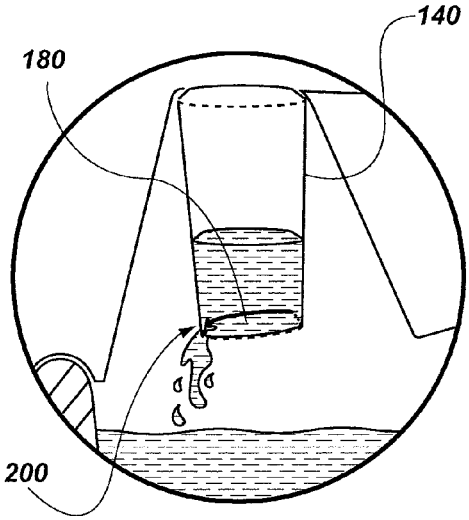
FIG. 7 is a detail view of the valve chamber of the lid of FIG. 5 showing the valve in a closed position and a fluid in the valve chamber draining from the valve chamber into a container.
Figure 8:
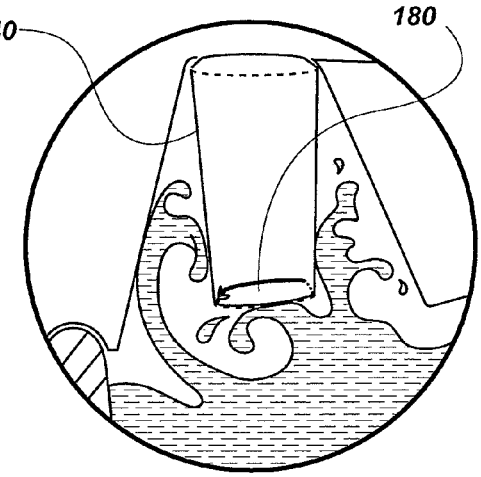
FIG. 8 is a detail view of the valve chamber of the lid of FIG. 5 showing the valve in a closed position and with a fluid splashing in the inside of the container.
Figure 15:
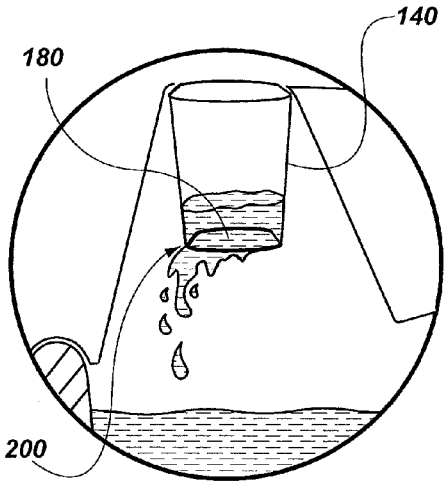
FIG. 15 is a detail view of the valve chamber of the lid of FIG. 13 showing the valve in a closed position and a fluid in the valve chamber draining from the valve chamber into the container.
Figure 16:
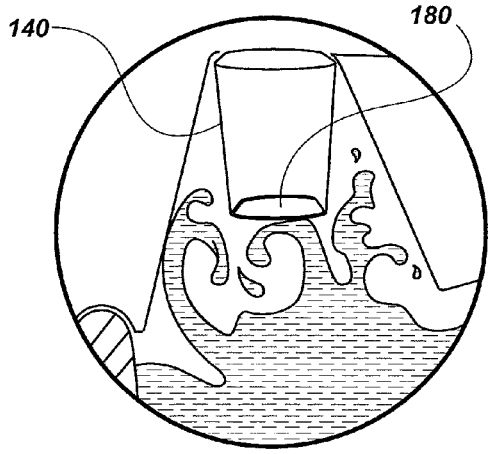
FIG. 16 is a detail view of the valve chamber of the lid of FIG. 13 showing the valve in a closed position and with a fluid splashing in the inside of the container.

When the pressure is substantially equalized between inside and outside the container 110, the valve flap 180 may be biased by the hinge 190 to return to the substantially closed positioned. When the valve flap 180 is in the substantially closed position, any liquid in the valve chamber 140 may drain back into the container 110 through the drain 200, as illustrated in FIGS. 7 and 15. Furthermore, with the valve flap 180 in the substantially closed position, any splashing of the liquid within the container 110 may be retained substantially inside the container 110, as is illustrated in FIGS. 8 and 16. In other words, the valve flap 180 in the substantially closed position inhibits splashing liquid inside the container 110 from escaping the container 110.

The lid 120 may be formed from conventional materials. By way of example and not limitation, the lid 120 may comprise a plastic material (i.e., a polymer) formed by conventional techniques, such as one or more of thermal forming (i.e., thermoforming), vacuum forming (i.e., vacuforming), injection molding, and other forming processes. In at least some embodiments, the lid 120, including the valve chamber 140, may be formed with the valve flap 180 attached to every side of the valve chamber 140. The sides of the valve flap 180 where there is no hinge 190 may be cut free from the valve chamber 140 using a punch or other known process, resulting in a hinge 190 where the valve flap 180 is not cut free from the valve chamber 140. In view of this, the entire lid 120, including the valve chamber 140 and valve flap 180, may be a single, monolithic structure.

While certain embodiments have been described and shown in the accompanying drawings, such embodiments are merely illustrative and not restrictive of the scope of the invention, and the invention is not limited to the specific constructions and arrangements shown and described, since various other additions and modifications to, and deletions from, the described embodiments will be apparent to one of ordinary skill in the art. Thus, the scope of the invention is only limited by the literal language, and equivalents, of the claims which follow.

What is claimed is:

1. A lid, comprising:

a valve chamber, the valve chamber comprising:

a hollow chamber defined by one or more sidewalls having a first opening at a first longitudinal end and a second opening at an opposing, second longitudinal end;

a valve flap positioned at least proximate to the second longitudinal end, the valve flap having a shape and size substantially the same as or smaller than a shape and size of the second opening; and a hinge coupling the valve flap to the lid, the hinge sized and configured to enable rotation of the valve flap from an open position to a substantially closed position and to bias the valve flap to the substantially closed position, wherein the valve flap inhibits the flow of liquid through the second opening in the substantially closed position;

wherein the lid is a monolithic structure, wherein the lid is shaped and configured to nest with a substantially identical lid with the valve chamber positioned partially within and with the valve flap positioned fully within a valve chamber of the substantially identical lid and with the lid positioned at a parallel orientation to the substantially identical lid.

2. The lid of claim 1, wherein the valve chamber further comprises a drain positioned at least proximate to the second longitudinal end, the drain defined by a slit-like opening between the valve flap and at least one of the one or more side walls, the drain configured to flow residual fluid therethrough when the valve flap is in the substantially closed position.

3. The lid of claim 1, wherein the valve flap is sized and configured to rotate about the hinge into the hollow chamber when the valve flap is rotated from the substantially closed position to the open position.

4. The lid of claim 1, further comprising a channel configured to engage a rim of a corresponding container to form a seal therebetween, the lid and channel sized to cover a radially outermost surface of the rim of the corresponding container.

5. A container assembly, comprising:

a container configured to hold a liquid therein, the container comprising a rim; and a lid sealed to the container, the lid comprising:

a channel engaging the rim of the container and forming a seal therebetween, the lid covering a peripherally outermost surface of the rim of the container; and a valve chamber, the valve chamber comprising:

a hollow chamber defined by one or more sidewalls having a first opening at a first longitudinal end and a second opening at an opposing, second longitudinal end;

a valve flap positioned at least proximate to the second longitudinal end, the valve flap having a shape and size substantially the same as or smaller than a shape and size of the second opening; and a hinge coupling the valve flap to the lid, the hinge sized and configured to enable rotation of the valve flap from an open position to a substantially closed position and to bias the valve flap to the substantially closed position, wherein the valve flap inhibits the flow of liquid through the second opening in the substantially closed position;

wherein the lid is a monolithic structure that is shaped and configured to nest with a substantially identical lid with the valve chamber positioned partially within and with the valve flap positioned fully within a valve chamber of the substantially identical lid and with the lid positioned at a parallel orientation to the substantially identical lid.

6. The container assembly of claim 5, wherein the valve chamber further comprises a drain defined by a slit-like opening between the valve flap and at least one of the one or more side walls, the drain for draining liquid from the valve chamber into the container when the valve flap is in the substantially closed position.

7. The container assembly of claim 5, wherein the valve flap is sized and configured to rotate about the hinge into the hollow chamber when the valve flap is rotated from the substantially closed position to the open position.

8. A method of forming a lid, comprising:

forming a single, monolithic structure, comprising:

forming a channel configured to engage and seal around a rim of a container; and forming a valve chamber comprising:

a hollow chamber defined by one or more sidewalls having a first opening at a first longitudinal end and a second opening at an opposing, second longitudinal end;

a valve flap positioned at least proximate to the second longitudinal end, the valve flap having a shape and size smaller than a shape and size of the second opening, a drain defined by a slit-like opening between the valve flap and at least one of the one or more side walls, the drain configured to flow residual fluid therethrough when the valve flap is in a substantially closed position; and a hinge coupling the valve flap to the lid, the hinge sized and configured to enable rotation of the valve flap from an open position to a substantially closed position and to bias the valve flap to the substantially closed position, wherein the valve flap inhibits the flow of liquid through the second opening in the substantially closed position, wherein the lid is formed to nest with a substantially identical lid with the valve chamber positioned partially within and the valve flap positioned fully within a valve chamber of the substantially identical lid and with the lid positioned at a parallel orientation to the substantially identical lid.

9. The method of claim 8, further comprising forming the lid with a thermal vacuum forming process.

10. The method of claim 9, further comprising forming the valve flap and the slit-like opening defining the drain by cutting the formed valve chamber.

11. The lid of claim 1, wherein the hinge couples the valve flap to a sidewall of the one or more sidewalls of the lid.

12. The container assembly of claim 5, wherein the hinge couples the valve flap to a sidewall of the one or more sidewalls of the lid.

13. The method of claim 8, wherein forming the valve chamber comprising the hinge coupling the valve flap to the lid comprises forming the valve chamber comprising a hinge coupling the valve flap to a sidewall of the one or more sidewalls of the lid.

14. The lid of claim 1, wherein the valve flap is configured to rotate from the substantially closed position to the open position responsive to less than atmospheric pressure.

15. The lid of claim 1, wherein the valve flap, when in the substantially closed position, is angled with respect to a horizontal position when the lid is coupled to a cup and the cup is set on a level surface.

16. The lid of claim 15, wherein the valve flap is angled from the hinge downward between about 1° and about 10° relative to the horizontal position when the valve flap is in the substantially closed position.

17. The lid of claim 1, wherein the lid is formed by a thermal vacuum forming process from a single sheet of material.

* * * * *